US006696800B2

(12) United States Patent
Kramer et al.

(10) Patent No.: US 6,696,800 B2
(45) Date of Patent: Feb. 24, 2004

(54) HIGH FREQUENCY ELECTRONIC BALLAST

(75) Inventors: Jerry Martin Kramer, Yorktown Heights, NY (US); Jerzy Janczak, Eindhoven (NL); Hendrik A. Van Esveld, Geldrop (NL); Ronald H. Van der Voort, Helmond (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/324,789

(22) Filed: Dec. 20, 2002

(65) Prior Publication Data

US 2003/0127995 A1 Jul. 10, 2003

Related U.S. Application Data

(63) Continuation-in-part of application No. 10/143,586, filed on Jan. 10, 2002.

(51) Int. Cl.[7] ..... H05B 37/02
(52) U.S. Cl. ..... 315/247; 315/209 R; 315/224
(58) Field of Search ..... 315/247, 209 R, 315/224, 246

(56) References Cited

U.S. PATENT DOCUMENTS 4,373,146 A * 2/1983 Bonazoli et al. ..... 315/209 R
5,121,034 A * 6/1992 Allen et al. ..... 315/246

* cited by examiner

*Primary Examiner*—David Vu
(74) *Attorney, Agent, or Firm*—Edward W. Goodman; Robert J. Kraus

(57) ABSTRACT

A method and ballast for driving a high intensity discharge (HID) lamp include generating a very high frequency driving signal for the HID lamp, generating a low frequency modulating signal, amplitude modulating the driving signal with the modulating signal at a predetermined low initial modulation level, measuring a lamp voltage across the HID lamp, determining a standard deviation of the lamp voltage, comparing the standard deviation with a predetermined minimum level, if the standard deviation is above the predetermined minimum level, incrementally increasing the modulation level and repeating the amplitude modulating step, the measuring step, the determining step and the comparing step, and if the standard deviation is below the predetermined minimum level, maintaining the amplitude modulation at the determined level.

13 Claims, 4 Drawing Sheets

HIGH FREQUENCY ELECTRONIC BALLAST

CROSS-REFERENCE TO RELATED APPLICATIONS

This is a continuation-in-part of U.S. patent application Ser. No. 10/043,586, filed Jan. 10, 2002.

BACKGROUND OF THE INVENTION

1. Field of the Invention

The subject invention relates to controlling the operation of various types of gas discharge lamps, and in particular, an improvement in the operational performance of electronic ballasts within a high frequency range of a gas discharge lamp.

2. Description of the Related Art

High intensity discharge (HID) gas discharge lamps as known in the art suffer from acoustic resonances when such lamps are operated at high frequencies, i.e., between a few kHz and hundreds of kHz, depending on the type of lamp. However, the acoustic resonances significantly weaken in such gas discharge lamps in which the acoustic resonances do not have a negative affect on the performance of these gas discharge lamps when the lamps are operated at very high frequencies, i.e., above the highest acoustic resonance (e.g., 150 kHz for a 400 W metal halide lamp). However, a consequence of operating the gas discharge lamp in the VHF range is the generation of electro-magnetic interference. Additionally, when a gas discharge lamp is operated at VJF lamp currents, the electrode temperature modulation (i.e., the difference in anode and cathode temperatures) vanishes. This results in a different electrode operating condition, which could cause changes in the arc attachment on the electrode. Arc instabilities related with arc-electrode attachment have been found when 400 W metal halide lamps are operated at high frequencies, even up to as high as 500 kHz.

Back-arcing of a gas discharge lamp involves an arc attachment of the arc on the back of the electrode coil of the lamp, as opposed to an ideal arc attachment of the arc at the tip of the electrode. This can affect thermal balance of the end of the arc tube, which, in turn, can affect the vapor pressures. Consequently, the color properties of the lamp are affected.

There are a number of known methods for operating HID lamps stably at high frequencies. A first method is to operate at a current frequency that is below the frequency of the lowest acoustic resonance. This method is limited to very low power lamps because acoustic resonance frequencies scale as one over an inner dimension of the lamp envelope. For higher wattage (larger) lamps, the lowest acoustic resonance frequencies are below 40 kHz power frequency (20 kHz current frequency) and the circuit can produce audible noise. A second method is to find a "resonance free window" that lies between the acoustic resonance frequencies. This method depends critically on the dimensions of the lamp. Small variations in manufacturing tolerances or changes in lamp parameters over the life of the lamp can make this "window" disappear. A variation on this method is to frequency sweep through a range of weak resonances. Again, the frequency range is very dependent on lamp dimensions. A third method for operating an HID lamp stably, is to increase the frequency sufficiently such that the acoustic resonances are damped. In this case, it is hard to guarantee that very weak resonances will not occur. The frequencies of these weak resonances vary unpredictably from lamp to lamp and can even vary from one operating period to another. Frequency sweeping at VHF has not proven totally successful in eliminating these instabilities.

SUMMARY OF THE INVENTION

It is an object of the invention to be able to drive an HID lamp at very high frequencies while eliminating arc instabilities. This object is achieved in a method of driving a high intensity discharge (HID) lamp, comprising the steps generating a very high frequency driving signal for said HID lamp; generating a low frequency modulating signal; amplitude modulating said driving signal with said modulating signal at a level of 10% to 30%; and applying said amplitude modulated driving signal to said HID lamp.

Applicants have found that when the modulating signal has a frequency of substantially 100 Hz, and the driving signal has a frequency in the range of 100 kHz to 500 kHz, stabilization of the arc of the HID lamp is attainable.

Since the properties of each lamp have a direct bearing on the stability, in a preferred embodiment of the invention, the method of driving a high intensity discharge (HID) lamp, comprises the steps generating a very high frequency driving signal for said HID lamp; generating a low frequency modulating signal; amplitude modulating said driving signal with said modulating signal at a predetermined low initial modulation level; measuring a lamp voltage across said HID lamp; determining a standard deviation of said lamp voltage; comparing said standard deviation with a predetermined minimum level; if said standard deviation is above said predetermined minimum level, incrementally increasing said modulation level and repeating said amplitude modulating step, said measuring step, said determining step and said comparing step; and if said standard deviation is below said predetermined minimum level, maintaining said amplitude modulation at said determined level. This method may be modified by first trying the amplitude modulation when the driving frequency is at an initial value. Then, if the standard deviation does not drop below the predetermined minimum level when the amount of amplitude modulation reaches a predetermined amount, the driving frequency may be incrementally increased (or decreased) and the procedure repeated until the appropriate combination of driving frequency and amount of amplitude modulation is achieved.

BRIEF DESCRIPTION OF THE DRAWINGS

With the above and additional objects and advantages in mind as will hereinafter appear, the subject invention will be described with reference to the accompanying drawings, in which.

DESCRIPTION OF THE PREFERRED EMBODIMENTS

Figure 1:
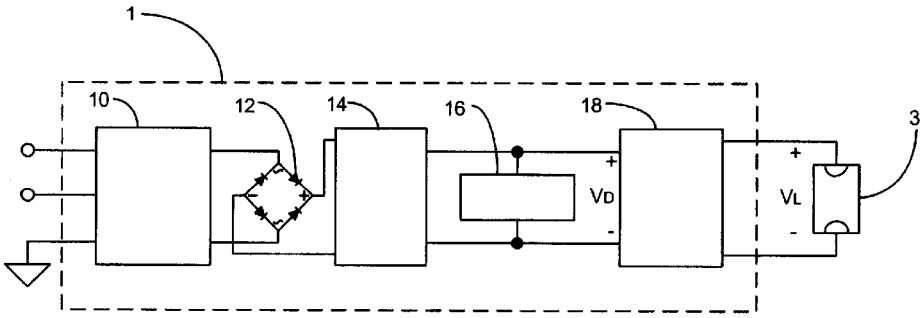
FIG. 1 shows a block circuit diagram of a ballast driving a lamp in accordance with the subject invention.

FIG. 1 shows a block circuit diagram of a ballast 1 incorporating the subject invention for providing a lamp current IL to a conventional lamp 3. The ballast 1 includes an electro-magnetic interference filter 10 for filtering line voltage applied thereto. A line voltage rectifier 12 rectifies the line voltage from the filter 10 and provides a DC voltage $V_D$ to a boost converter 14. An energy buffer 16 is connected across the output from the boost converter 14, the output therefrom being also applied to a half-bridge circuit 18. An output from the half-bridge circuit 18 forms the output of the ballast 1 and is applied to the lamp 3.

Figure 2:
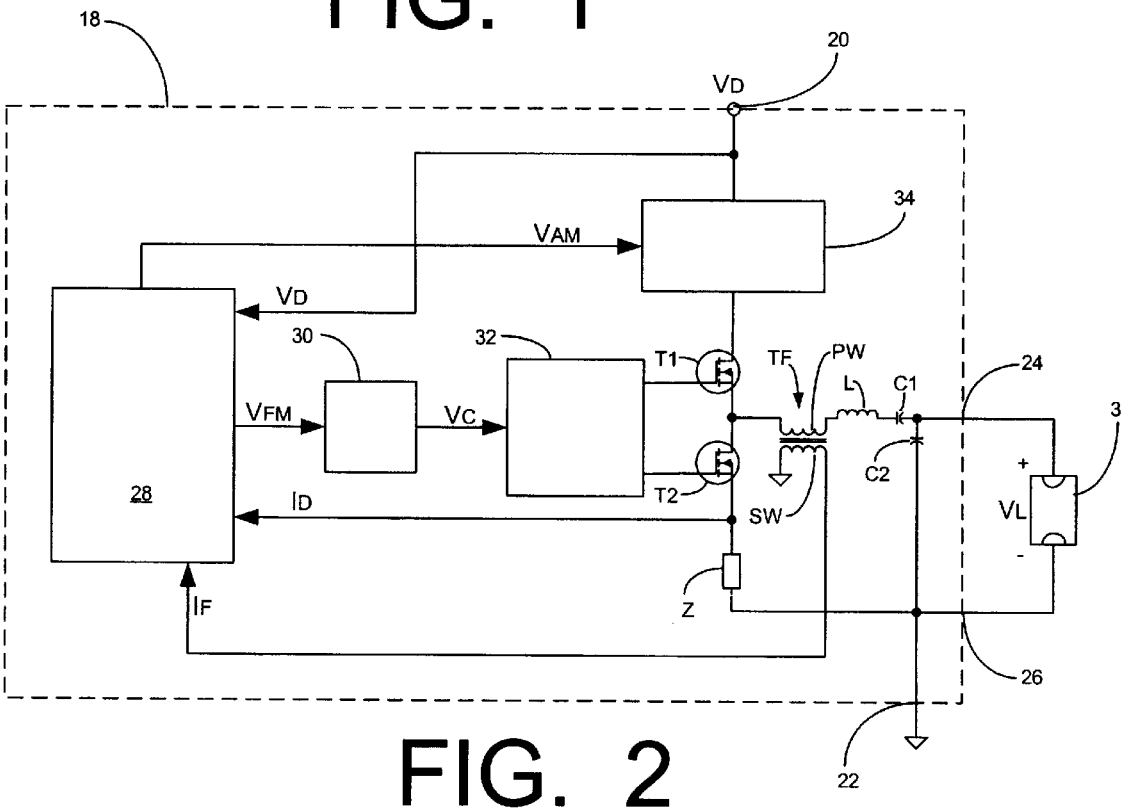
FIG. 2 shows a block circuit diagram of a half-bridge circuit for use in the ballast of FIG. 1.

FIG. 2 shows an embodiment of the half-bridge circuit 18. The half-bridge circuit 18 includes the series arrangement of a first switch T1 and a second switch T2, shown as MOSFETs, and an impedance Z connected between the input terminals 20 and 22 of the half-bridge circuit 18 receiving the voltage $V_D$. A series arrangement of a primary winding PW of a transformer TF, an inductor L, a first capacitor C1 and a second capacitor C2 is connected between the junction between the first and second switches T1 and T2, and the second input terminal 22. The output terminals 24 and 26 of the half-bridge circuit 18 are arranged across the second capacitor C2 and are connectable to the lamp 3.

A micro-controller 28 receives the voltage $V_D$ from the first input terminal 20 and a current $I_D$ from the junction between the second switch T2 and the impedance Z. In addition, the secondary winding SW of the transformer TF, having one end connected to ground, supplies the current $I_F$ to the micro-controller 28. In response to the voltage $V_D$ and the currents $I_D$ and $I_F$, the micro-controller 28 generates a control voltage $V_{FM}$ for controlling the oscillating frequency of voltage-controlled oscillator 30 at the desired operating frequency of the lamp. The voltage-controlled oscillator 30 generates a control voltage $V_C$ at the operating frequency to a half-bridge driver circuit 32. In response to the control voltage $V_C$, the half-bridge driver circuit 32 generates the drive signals for the gates of the first and second switches T1 and T2. Amplitude modulation of the signal to the lamp can be accomplished by amplitude modulating the bus voltage $V_C$. To that end, amplitude modulator 34 is included between the input 20 and the first switch T1. The amplitude modulator 34 has a control input coupled to an output from the micro-controller 28 for receiving a control signal $V_{AM}$ indicative of the desired amount of amplitude modulation. It should be understood that there are other arrangements for amplitude modulating the signal to the lamp, which may be substituted for the above-described embodiment.

Figure 3:
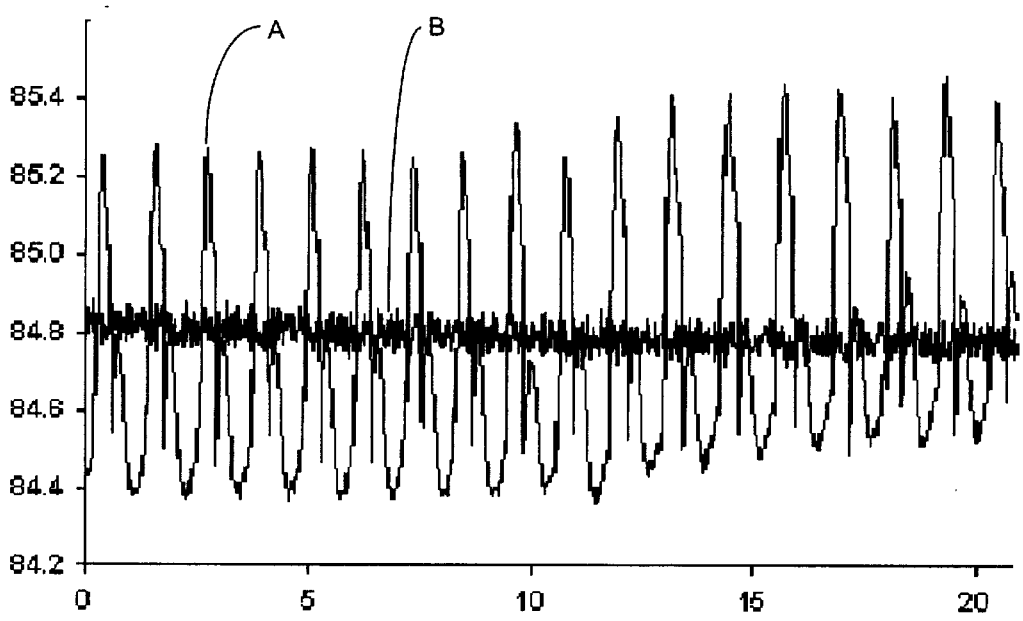
FIG. 3 shows a graph of the lamp voltage in one embodiment of the subject invention.
Figure 4:
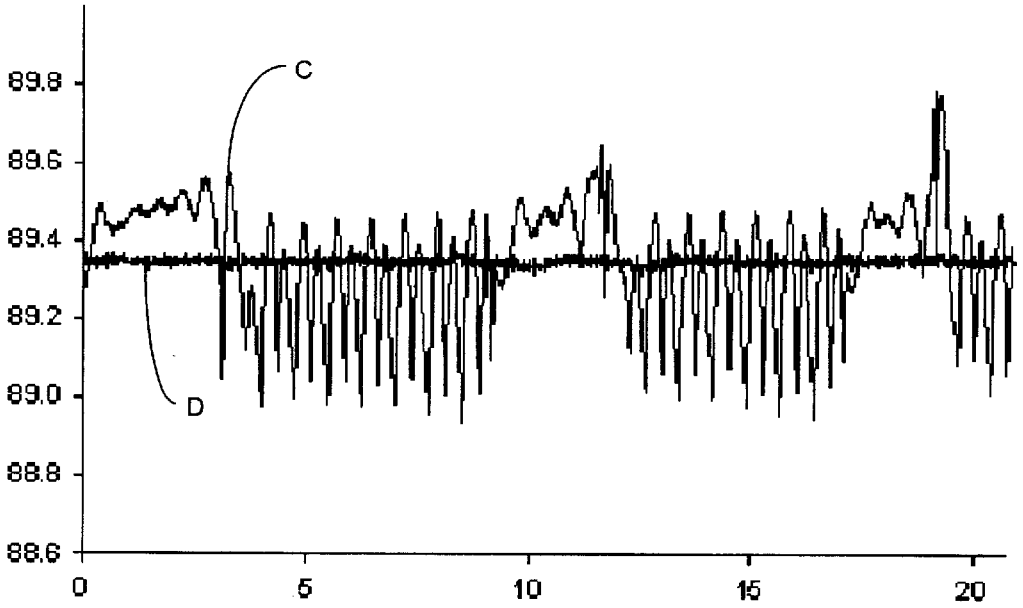
FIG. 4 shows a graph of the lamp voltage in another embodiment of the subject invention.

Applicants have found that it is not sufficient to merely amplitude modulate the VHF drive voltage for the lamp in order to achieve stable operation of the HID lamp. While the amplitude modulating waveform may be a sine wave, a square wave, a ramp or a triangle wave, it is also necessary for the amplitude modulation to be significant. In one example, a 150 W HID lamp with a ceramic envelope was operated at 500 kHz current frequency. The voltage waveform to the lamp was then modulated with a 100 mV square wave signal at 100 Hz, corresponding to a 10% modulation. As shown in FIG. 3, the waveform A represents the lamp voltage $V_L$ over an approximately 20 second time period without amplitude modulation, while waveform B represents the lamp voltage $V_L$ over the same time with the amplitude modulation. As should be apparent, the large excursions of the lamp voltage, as shown in waveform A, are indicative of arc instabilities. With the appropriate amount of amplitude modulation, as shown in waveform B, the large excursions of the lamp voltage have been eliminated and the lamp operation is stable. In a second example, as shown in FIG. 4, the lamp was operated at 400 kHz current frequency. In FIG. 4, waveform C represents the lamp voltage $V_L$ over an approximately 20 second time period without amplitude modulation, while waveform D represents the lamp voltage $V_L$ over the same time with the amplitude modulation.

Figure 5:
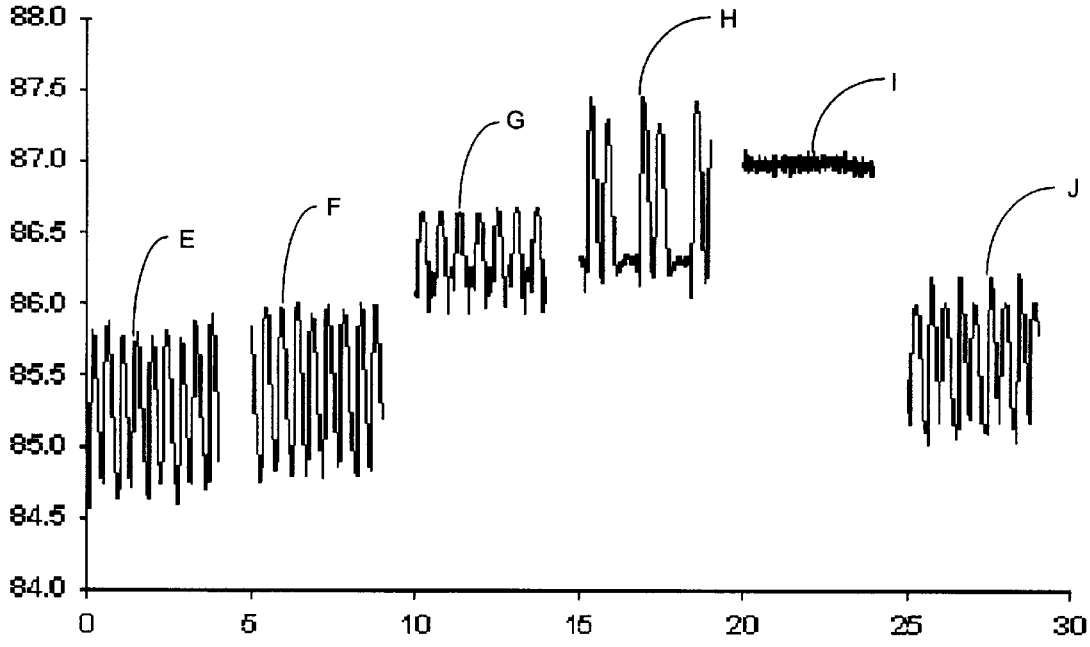
FIG. 5 shows a graph of the lamp voltage when the amplitude modulation is incrementally increased.

As the operating conditions of each lamp are different, and the operating parameters of a lamp may change over time, it may be necessary to change the amount of amplitude modulation. FIG. 5 shows the effects of incrementally increasing the amplitude modulation. In particular, a 150 W HID lamp with a ceramic envelope was operated at 500 kHz current frequency. The lamp voltage $V_L$ periodically varied with time and is shown for 4 second intervals. Amplitude modulation of the VHF signal was then incrementally increased until, at 250 mV (approx. 25% modulation), the lamp stabilized. In particular, waveform E shows the lamp voltage $V_L$ without amplitude modulation, waveform F shows the lamp voltage $V_L$ in which the modulation level was at 100 mV, waveform G shows the lamp voltage $V_L$ in which the modulation level was at 150 mV, waveform H shows the lamp voltage $V_L$ in which the modulation level was at 200 mV, and waveform I shows the lamp voltage $V_L$ in which the modulation level was at 250 mV. It should be appreciated that the lamp voltage $V_L$ shows significantly smaller variations in waveform I as opposed to in waveforms E–H, thereby signifying stable operation. When the amplitude modulation was removed, the lamp resorted to its unstable operation (waveform J).

Figure 6:
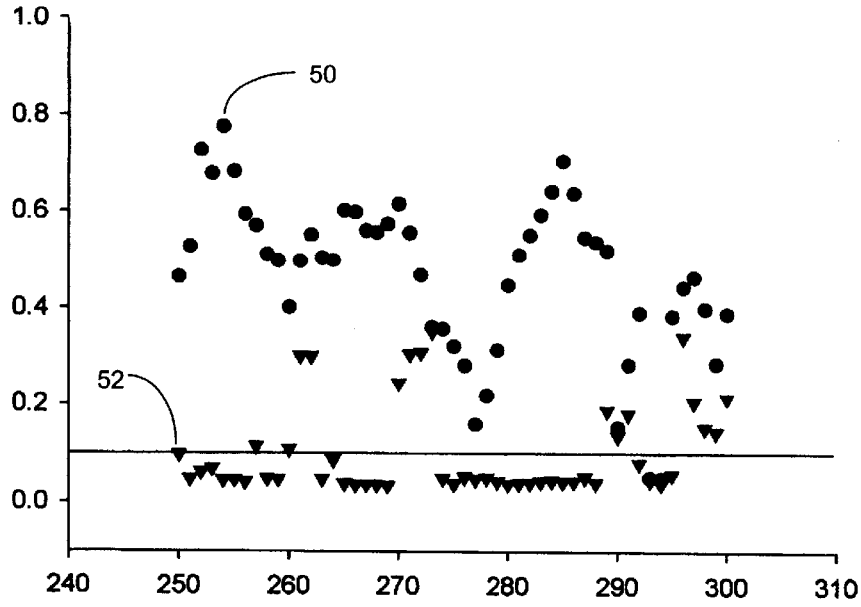
FIG. 6 shows a graph of the standard deviation of one embodiment of a lamp with the lamp voltage at differing driving frequencies.

With the above in mind, Applicants have determined that the amount of needed amplitude modulation may be determined by examining the standard deviation of the lamp voltage $V_L$. When the arc of the lamp becomes unstable, it deviates from its normal length and this produces a distribution of voltages. In an exemplary study, the lamp voltage waveform was digitized over a 10 ms period (corresponding to one period of the amplitude modulation signal) and the rms voltage was calculated. This measurement was repeated 500 times and the standard deviation of these 500 measurements was calculated. The total time for each standard deviation measurement was approximately 10 s. A 70 W cylindrical discharge lamp was operated at integer VHF current frequencies from 250 to 300 kHz without amplitude modulation. Of these 51 discrete frequencies, only 3 were stable (instabilities persisted above 400 kHz). With the addition of 30% amplitude modulation with a 100 Hz square wave, 34 of the frequencies were stable. This is illustrated in FIG. 6 which plots the standard deviation of 500 voltage measurements without amplitude modulation (circles 50) and with amplitude modulation (triangles 52) at current frequencies from 250 to 300 kHz. The horizontal line at a standard deviation of 0.1 is the approximate dividing line between arc stability (<0.1) and arc instability (>0.1). The effect of percentage amplitude modulation required to stabilize this 70 W lamp was investigated for a 100 Hz square wave and a 100 Hz sine wave. The VHF frequency was 285 kHz, which was unstable without amplitude modulation. In the case of the square wave modulation, the arc was stable with 20% to 30% modulation, and in the case of sine wave modulation, the arc was stable from 15% to 30% modulation.

The modulation frequency was investigated with 30% amplitude modulation with a square wave and a sine wave. With square wave modulation, the lamp was stable at 100 and 400 Hz, but at 200 Hz, there was a periodic movement of the discharge. By 500 Hz, there was a rapid flicker at the bottom electrode and the lamp was unstable at 1000 Hz. With sine wave modulation, the arc was stable at 100 Hz and 200 Hz, but at 400 Hz, there were intermittent instabilities. By 500 Hz, the lamp was unstable. The lower limit of the modulation frequency is determined by the perception of flicker caused by the strong modulation of the lamp power and light output.

Figure 7:
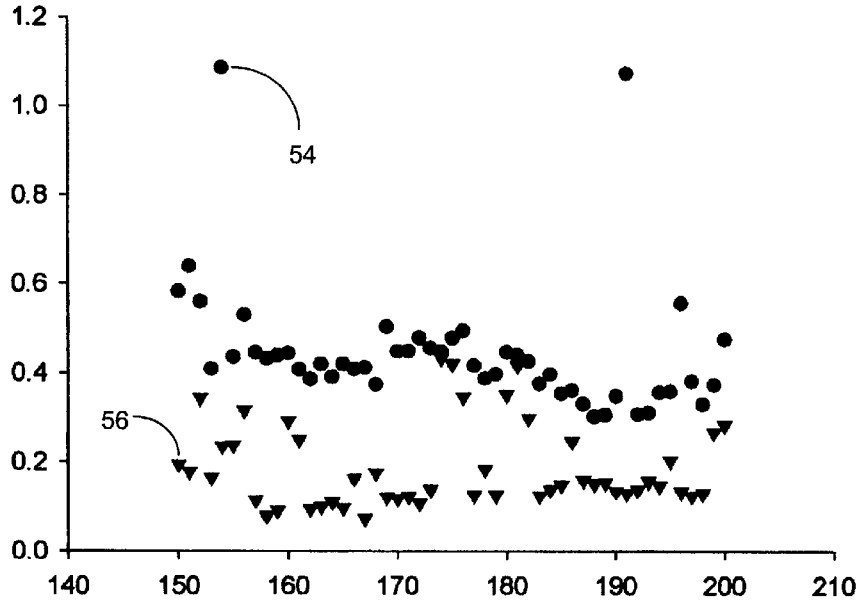
FIG. 7 shows a graph of the standard deviation of another embodiment of a lamp with the lamp voltage at differing driving frequencies.

In a second example, a 100 W non-cylindrical HID lamp with a quartz envelope was stabilized using amplitude modulation. The lamp was unstable in a vertical orientation at all 51 VHF frequencies from 150 to 200 kHz. With the addition of 30% square wave amplitude modulation, the lamp stability increased dramatically at many of these frequencies. This is illustrated in FIG. 7 which plots the standard deviation of 500 voltage measurements without amplitude modulation (circles 54) and with amplitude modulation (triangles 56).

Figure 8:
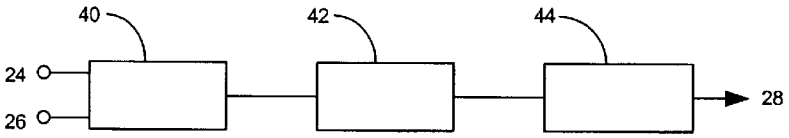
FIG. 8 shows a modification for the embodiment of FIG. 2, in which the standard deviation of the lamp voltage is monitored.

In view of the above, Applicants have devised a modification of the circuit of FIG. 2. As shown in FIG. 8, the lamp voltage VL is applied to an analog-to-digital (A/D) converter 40. The digitized lamp voltage is then applied to a standard deviation circuit 42 which calculates the standard deviation of the lamp voltage over a predetermined period of time. This standard deviation is then applied to a threshold detector 44 which determines when the standard deviation is below a predetermined level indicative of stable operation of the lamp. An output of the threshold detector 44 is applied to the micro-controller 28.

In operation, the micro-controller 28 initially does not generate an output modulation signal for the amplitude modulator 34. Based on the output of the threshold detector 44, the micro-controller 28 begins generating an output modulation signal at a predetermined minimal amount, and incrementally increases the amount of amplitude modulation, while the results are monitored by the A/D converter 40, the standard deviation circuit 42 and the threshold detector 44. Once the standard deviation of the lamp voltage drops below the predetermined threshold in the threshold detector 44, the micro-controller 28 stops increasing the amount of amplitude modulation, which then remains at the optimum level.

It may be that after the above procedure, the standard deviation of the lamp voltage is still above the predetermined threshold. As such, it will be necessary for the micro-controller 28 to change the frequency of operation of the lamp and then repeat the incremental increasing of the amount of amplitude modulation. To that end, the above operation is modified in that the micro-controller 28 initially supplies a control signal to the VCO 30 causing the VCO 30 to operate at a predetermined initial frequency. Based on the output of the threshold detector 44, the micro-controller 28 begins generating an output modulation signal at a predetermined minimal amount, and incrementally increases the amount of amplitude modulation, while the results are monitored by the A/D converter 40, the standard deviation circuit 42 and the threshold detector 44. Once the standard deviation of the lamp voltage drops below the predetermined threshold in the threshold detector 44, the micro-controller 28 stops increasing the amount of amplitude modulation, which then remains at the optimum level. If the standard deviation of the lamp voltage does not drop below the predetermined threshold once the amount of amplitude modulation reaches, for example, 30%, the micro-controller 28 incrementally increases the frequency of the VCO 30 and then repeats the incremental increasing of the amount of amplitude modulation. This is continued until the appropriate combination of frequency and amount of amplitude modulation is achieved.

Numerous alterations and modifications of the structure herein disclosed will present themselves to those skilled in the art. However, it is to be understood that the above described embodiment is for purposes of illustration only and not to be construed as a limitation of the invention. All such modifications which do not depart from the spirit of the invention are intended to be included within the scope of the appended claims.

What is claimed is:

1. A method of driving a high intensity discharge (HID) lamp, comprising the steps:

generating a very high frequency driving signal for said HID lamp;

generating a low frequency modulating signal;

amplitude modulating said driving signal with said modulating signal at a level of 10% to 30%; and applying said amplitude modulated driving signal to said HID lamp.

2. The method as claimed in claim 1, wherein said modulating signal has a frequency of substantially 100 Hz.

3. The method as claimed in claim 1, wherein said driving signal has a frequency in the range of 100 kHz to 500 kHz.

4. A method of driving a high intensity discharge (HID) lamp, comprising the steps:

(a) generating a very high frequency driving signal for said HID lamp;

(b) generating a low frequency modulating signal;

(c) amplitude modulating said driving signal with said modulating signal at a predetermined low initial modulation level;

(d) measuring a lamp voltage across said HID lamp;

(e) determining a standard deviation of said lamp voltage;

(f) comparing said standard deviation with a predetermined minimum level;

(g) if said standard deviation is above said predetermined minimum level, incrementally increasing said modulation level and repeating steps (c), (d), (e) and (f); and if said standard deviation is below said predetermined minimum level, maintaining said amplitude modulation at said determined level.

5. The method as claimed in claim 4, wherein said driving signal is in a frequency range of 100 kHz to 500 kHz.

6. The method as claimed in claim 5, wherein said modulating signal has a frequency of substantially 100 Hz.

7. The method as claimed in claim 6, wherein said driving signal is initially set at the bottom of said frequency range, and if at step (f) said standard deviation does not drop below said predetermined minimum level when the amount of amplitude modulation reaches a predetermined amount, the driving signal frequency is incrementally increased and said method of amplitude modulating at an initial level and incrementally increased levels is repeated at step (b).

8. An electronic ballast for driving a high intensity discharge (HID) lamp, said ballast comprising:

a source for direct current voltage;

a converter for converting said direct current voltage into a direct current drive voltage;

means for generating a very high frequency driving signal for said HID lamp;

means for generating a low frequency modulating signal;

means for amplitude modulating said driving signal with said modulating signal at a level of 10% to 30%; and means for applying said amplitude modulated driving signal to said HID lamp.

9. The electronic ballast as claimed in claim 8, wherein said modulating signal has a frequency of substantially 100 Hz.

10. The electronic ballast as claimed in claim 8, wherein said driving signal has a frequency in the range of 100 kHz to 500 kHz.

11. An electronic ballast for driving a high intensity discharge (HID) lamp, said ballast comprising:

a source for direct current voltage;

a converter for converting said direct current voltage into a direct current drive voltage;

means for generating a very high frequency driving signal for said HID lamp;

means for generating a low frequency modulating signal;

means for amplitude modulating said driving signal with said modulating signal at a predetermined low initial modulation level;

means for measuring a lamp voltage across said HID lamp;

means for determining a standard deviation of said lamp voltage; and means for comparing said standard deviation with a predetermined minimum level;

wherein, if said standard deviation is above said predetermined minimum level, said amplitude modulating means incrementally increases said modulation level and said measuring means, said determining means and said comparing means repeat their respective functions; and if said standard deviation is below said predetermined minimum level, said amplitude modulating means maintains said amplitude modulation at said determined level.

12. The electronic ballast as claimed in claim 11, wherein said driving signal is in a frequency range of 100 kHz to 500 kHz.

13. The electronic ballast as claimed in claim 12, wherein said modulating signal has a frequency of substantially 100 Hz.

* * * * *